US011192176B1

(12) United States Patent
Liu et al.

(10) Patent No.: US 11,192,176 B1
(45) Date of Patent: Dec. 7, 2021

(54) METHOD FOR IMPROVING CENTER SEGREGATION AND SURFACE CRACK OF CONTINUOUS CASTING MEDIUM THICK SLAB OF PERITECTIC STEEL

(71) Applicant: UNIVERSITY OF SCIENCE AND TECHNOLOGY BEIJING, Beijing (CN)

(72) Inventors: Qing Liu, Beijing (CN); Yanshen Han, Beijing (CN); Jiangshan Zhang, Beijing (CN)

(73) Assignee: UNIVERSITY OF SCIENCE AND TECHNOLOGY BEIJING, Beijing (CN)

( * ) Notice: Subject to any disclaimer, the term of this patent is extended or adjusted under 35 U.S.C. 154(b) by 0 days.

(21) Appl. No.: 17/226,019

(22) Filed: Apr. 8, 2021

Related U.S. Application Data

(63) Continuation-in-part of application No. PCT/CN2020/107420, filed on Aug. 6, 2020.

(30) Foreign Application Priority Data

Jun. 17, 2020 (CN) ..... 202010554045.9

(51) Int. Cl.
*B22D 11/124* (2006.01)
*B22D 11/14* (2006.01)
(Continued)

(52) U.S. Cl.
CPC ..... *B22D 11/1287* (2013.01); *B22D 11/1245* (2013.01); *B22D 11/142* (2013.01); *B22D 11/225* (2013.01)

(58) Field of Classification Search
CPC ..... B22D 11/04; B22D 11/055; B22D 11/124; B22D 11/1245; B22D 11/1287; B22D 11/22; B22D 11/225
See application file for complete search history.

(56) References Cited

U.S. PATENT DOCUMENTS 4,169,498 A * 10/1979 Wilhelm ..... B22D 11/225 164/455

FOREIGN PATENT DOCUMENTS

CN 1117412 A 2/1996
CN 101081428 A 12/2007
(Continued)

OTHER PUBLICATIONS

Machine translation of Cho et al (KR 20170046402A, published May 2, 2017, cited in IDS filed Apr. 8, 2021). (Year: 2017).*

*Primary Examiner* — Kevin E Yoon
*Assistant Examiner* — Jacky Yuen
(74) *Attorney, Agent, or Firm* — Novick, Kim & Lee, PLLC; Allen Xue

(57) ABSTRACT

A method for improving center segregation and surface crack of continuous casting medium-thick slab of peritectic steel reduces the cooling intensity at the earlier stage of solidification and enhancing the cooling intensity at the final stage of solidification. For example, the cooling water amount of the wide face of the mould is 3400-3600 L/min, and the cooling water amount of the narrow face of the mould is 480-530 L/min. The cooling water amount of the wide face of the foot roller section is 239-298 L/min, and the cooling water amount of the narrow face of the foot roller section is 61-65 L/min. The total cooling water amount of the sector segment is 1517-2166 L/min.

7 Claims, 1 Drawing Sheet

(51) Int. Cl.
*B22D 11/22* (2006.01)
*B22D 11/128* (2006.01)

(56) References Cited

FOREIGN PATENT DOCUMENTS

| | | | | |
|---|---|---|---|---|
| CN | 101992282 | A | | 3/2011 |
| CN | 102744383 | A | | 10/2012 |
| CN | 103215496 | A | | 7/2013 |
| CN | 106929753 | A | | 7/2017 |
| CN | 107838390 | A | | 3/2018 |
| CN | 107866538 | A | | 4/2018 |
| CN | 107891132 | A | | 4/2018 |
| CN | 108160964 | A | | 6/2018 |
| CN | 108672666 | A | | 10/2018 |
| CN | 108823492 | A | | 11/2018 |
| CN | 109261922 | A | | 1/2019 |
| CN | 109940140 | A | | 6/2019 |
| CN | 110560652 | A | * | 12/2019 |
| EP | 0153062 | A2 | | 8/1985 |
| JP | H01170551 | A | | 7/1989 |
| KR | 20170046402 | A | | 5/2017 |

* cited by examiner

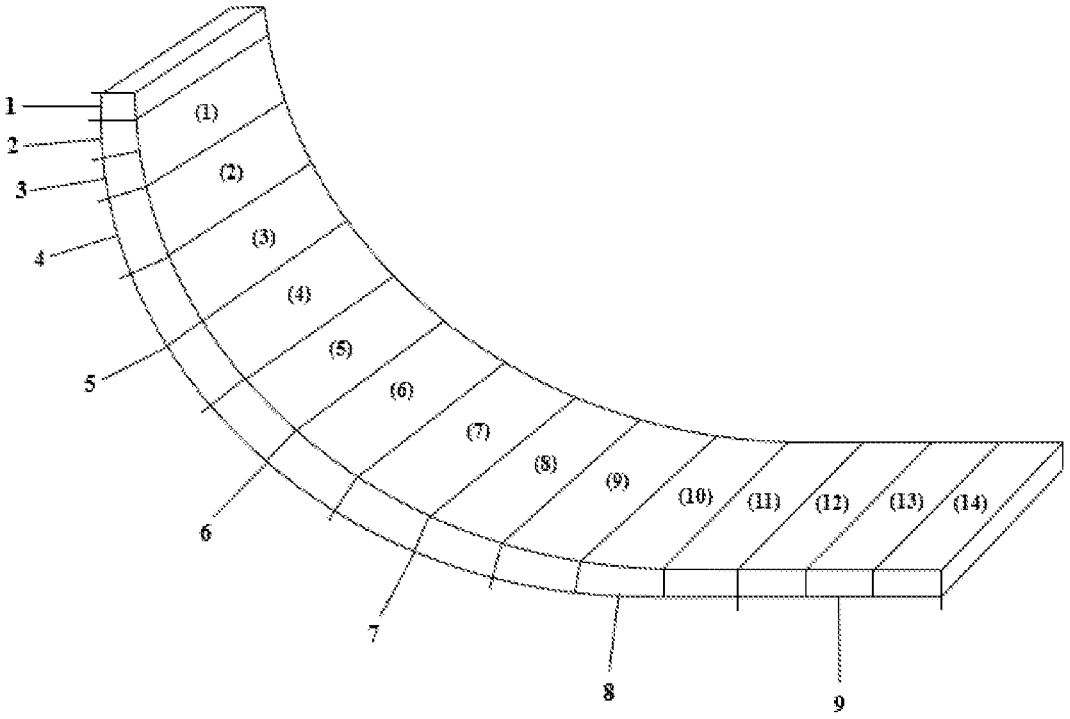
1
2
3
4
5
6
7
8
9
(1)
(2)
(3)
(4)
(5)
(6)
(7)
(8)
(9)
(10)
(11)
(12)
(13)
(14)

METHOD FOR IMPROVING CENTER SEGREGATION AND SURFACE CRACK OF CONTINUOUS CASTING MEDIUM THICK SLAB OF PERITECTIC STEEL

TECHNICAL FIELD

The present invention relates to the technical field of continuous casting slab quality control, and in particular, to a method for improving center segregation and surface crack of a continuous casting medium-thick slab of peritectic steel.

BACKGROUND

Continuous casting, as a very important link in the steel production process, is one of the most important steel casting methods in the world at present. Solidification of continuous casting slab is a heat dissipation process, mainly depending on three main cooling stages: primary cooling in the mould, secondary cooling by water spraying, and radiation in the air cooling zone. Wherein, cooling water is the most important cooling medium, and the water amount distribution of primary cooling and the water amount distribution of secondary cooling directly affect the slab quality. In the production process of the continuous casting slab, the main purpose of the primary cooling in the mould is to ensure that the initially solidified shell has sufficient thickness when the continuous casting slab leaves the mould so as to reduce the occurrence rate of bleed-out accidents. The main purpose of the secondary cooling is to ensure that the cast slab is cooled uniformly and the decreasing or increasing rate of the surface temperature of the continuous casting slab is in a reasonable range so as to control the strength and plasticity of the slab in a reasonable range.

The center segregation of the continuous casting slab is a typical defect, which is mainly due to the non-uniform distribution of solute elements caused by the solubility difference of the solute elements in the solid phase and the liquid phase and the selective crystallization phenomenon during solidification of molten steel. The mechanical soft reduction technology and the electromagnetic stirring technology are two main auxiliary methods for improving the center segregation, and are combined with the water distribution system of continuous casting, thereby effectively improving the internal quality of the continuous casting slab. The water distribution system of continuous casting is to forcibly cool the molten steel in the continuous casting process, which directly affects the formation of the solidification structure of the continuous casting slab and affects the center segregation of the final continuous casting slab. Therefore, optimizing and controlling the water distribution system of continuous casting is an important measure to improve the center segregation of the continuous casting slab.

The surface crack of the continuous casting slab is a common defect in the continuous casting process, which seriously affects the quality of the rolled products. In the continuous casting process, the surface crack generally originates from the primary cooling stage of the mould, expands in the secondary cooling stage of continuous casting, and finally appears on the surface of the rolled products. In the continuous casting process, the molten steel is subjected to the primary cooling of the mould and the subsequent secondary cooling of the continuous casting. The cooling methods in the two zones affect the strength and plasticity of the solidified shell, and have an important influence on the surface crack of the continuous casting slab.

The center segregation and surface crack of the continuous casting slab are closely related to the solidification and cooling control process in the continuous casting process. Therefore, to improve the quality of the continuous casting slab, the two main defects in the continuous casting process should be considered as a whole when optimizing the solidification and cooling process. In particular, during continuous casting of the peritectic steel, due to peritectic reaction, δ phase and liquid phase react at the same time to produce the austenite phase in the solidification process of the molten steel, the volume shrinkage is large, and therefore the solidified shell generates large solidification shrinkage. The crack sensitivity of the initially solidified shell is increased due to non-uniform solidification and cooling. Therefore, in view of the solidification characteristic of the peritectic steel, when the solidification and cooling process of the continuous casting slab is optimized and controlled, the comprehensive influence on the center segregation and surface crack defects of the slab by the process should be considered specially to improve the quality of the continuous casting slab.

In consequence, it is necessary to develop a method for improving the center segregation and surface crack of the continuous casting medium-thick slab of peritectic steel to deal with the defects in the prior art so as to solve or alleviate one or more of the above problems.

SUMMARY

In view of this, the present invention provides a method for improving center segregation and surface crack of the continuous casting medium-thick slab of peritectic steel. By adjusting the cooling intensity at the earlier stage of solidification and the cooling intensity at the final stage of solidification, the center segregation and the surface crack of the continuous casting medium-thick slab of peritectic steel can be effectively improved.

In one aspect, the present invention provides a method for improving center segregation and surface crack of the continuous casting medium-thick slab of peritectic steel. By reducing the cooling intensity at the earlier stage of solidification and increasing the cooling intensity at the final stage of solidification, the center segregation and the surface crack of the continuous casting medium-thick slab of peritectic steel can be improved.

According to the above aspect and any possible implementation manner, an implementation manner is further provided. The method comprises the following contents:

1) the cooling water amount of the wide face of the mould is 3400-3600 L/min, and the cooling water amount of the narrow face of the mould is 480-530 L/min;

2) the cooling water amount of the wide face of the foot roller section is 239-298 L/min, and the cooling water amount of the narrow face of the foot roller section is 61-65 L/min;

3) the total cooling water amount of the sector segment is 1517-2166 L/min, wherein the total cooling water amount of the first section to the fourth section is 840-1101 L/min, and the total cooling water amount of the fifth section to the eighth section is 633-1001 L/min.

According to the above aspect and any possible implementation manner, an implementation manner is further provided. The cooling water setting process of the first section to the fourth section is: the cooling water amount of the lower part of the first section is 241-318 L/min, the cooling water amount of the inner arc of the second section is 84-110 L/min, the total cooling water amount of the outer arc of the second section is 95-126 L/min, the total water amount of inner arc of the third section to the fourth section is 75-93 L/min, and the total cooling amount of outer arc of the third section to the fourth section is 99-125 L/min.

According to the above aspect and any possible implementation manner, an implementation manner is further provided. The cooling water amount of the upper part of the first section is 246-329 L/min.

According to the above aspect and any possible implementation manner, an implementation manner is further provided. The setting process of the cooling water amount of the fifth section to the eighth section is: the total cooling water amount of inner arc of the fifth section to the sixth section is 140-189 L/min, the cooling water amount of outer arc of the fifth section to the sixth section is 223-302 L/min, the cooling water amount of inner arc of the seventh section to the eighth section is 97-184 L/min, and the cooling water amount of outer arc of the seventh section to the eighth section is 173-326 L/min.

According to the above aspect and any possible implementation manner, an implementation manner is further provided. The contents of the method further comprises:

4) the total cooling water amount of inner arc of the ninth section to the fourteenth section of the sector segment is 44-64 L/min, and outer arc of the ninth section to the fourteenth section of the sector segment do not spray water.

According to the above aspect and any possible implementation manner, an implementation manner is further provided. The water inlet temperature of cooling water is 30-40° C.

According to the above aspect and any possible implementation manner, an implementation manner is further provided. The casting speed of the continuous casting medium-thick slab of peritectic steel is 0.7-0.9 m/min.

According to the above aspect and any possible implementation manner, an implementation manner is further provided. The overall specific water amount of the foot roller section and the sector segment is 0.89-0.94 L/Kg.

In another aspect, the present invention provides the continuous casting medium-thick slab of peritectic steel, which is cast by the method for improving the center segregation and surface crack of the continuous casting medium-thick slab of peritectic steel as described above, wherein the proportion of the center segregation of the slab of peritectic steel within grade 2.6 reaches more than 82%, and the surface defect rate is less than 0.53%.

According to the above aspect and any possible implementation manner, an implementation manner is further provided. The section size of the continuous casting medium-thick slab of peritectic steel is 250 mm*1800 mm.

Compared with the prior art, the present invention can achieve the following technical effects: by implementing the continuous casting solidification and control strategy and water distribution solution of "appropriately reducing the cooling intensity at the earlier stage of solidification+intensive cooling at the final stage of solidification", the center segregation and surface crack of the continuous casting slab can be improved at the same time, so that the proportion of the center segregation of the continuous casting slab within grade 2.6 reaches more than 82%, and the surface defect rate is less than 0.53%.

Certainly, implementation of any product in the present invention does not necessarily need to achieve all of the foregoing technical effects.

BRIEF DESCRIPTION OF THE DRAWINGS

To more clearly describe the technical solutions in the embodiments of the present invention, the accompanying drawings required for describing the embodiments are briefly introduced below. Apparently, the accompanying drawings in the following description merely show some embodiments of the present invention, and a person of ordinary skill in the art may still derive other drawings from these accompanying drawings without creative efforts.

FIG. 1 shows the zoning schematic diagram of the secondary cooling section of a continuous casting machine provided by an embodiment of the present application.

In the drawing:

1: secondary cooling zone 1 (foot roller section), 2-9: secondary cooling zones 2-9, (1)-(14): secondary cooling sections 1-14.

DETAILED DESCRIPTION

For better understanding of the technical solutions of the present invention, the embodiments of the present invention will be described below in detail with reference to the accompanying drawings.

It should be clear that the described embodiments are merely a part rather than all of the embodiments of the present invention. All other embodiments obtained by a person of ordinary skill in the art based on the embodiments of the present invention without creative efforts shall fall within the protection scope of the present invention.

Terms used in the embodiments of the present invention are only for describing specific embodiments, and are not intended to limit the present invention. As used in the embodiments of the present application and the appended claims, the singular forms "a", "said" and "the" are intended to include the plural forms, unless the context clearly indicates other meanings.

An objective of the present invention is to provide a method for improving center segregation and surface crack of the continuous casting medium-thick slab of peritectic steel, especially the continuous casting medium-thick slab of peritectic steel with a cross-section size of 250 mm*1800 mm, by implementing the continuous casting solidification and control strategy and water distribution solution of "appropriately reducing the cooling intensity at the earlier stage of solidification+intensive cooling at the final stage of solidification", the center segregation and surface crack of the continuous casting slab can be improved at the same time. The targeted peritectic steel includes Q345D, Q345E or Q345qE steel, and the degree of superheat of the peritectic steel during casting is 20-30° C.

A method for improving center segregation and surface crack of the continuous casting medium-thick slab of peritectic steel specifically comprises the following steps:

Step 1: controlling the cooling water control amount of the wide face of the mould to be 3400-3600 L/min and the cooling water amount of the narrow face of the mould to be 480-530 L/min;

Step 2: controlling the cooling water amount of the wide face of the foot roller section to be 239-298 L/min and the cooling water amount of the narrow face of the foot roller section to be 61-65 L/min;

Step 3: controlling the total cooling water amount of the sector segment to be 1517-2166 L/min, wherein the total cooling water amount of the first section to the fourth section is 840-1101 L/min, and the total cooling water amount of the fifth section to the eighth section is 633-1001 L/min; the total cooling water amount of the first section to the fourth section specifically comprises: the cooling water amount of the lower part of the first section is 241-318 L/min, the cooling water amount of the inner arc of the second section is 84-110 L/min, the total cooling water amount of the outer arc of the second section is 95-126 L/min, the total cooling water amount of the inner arc of the third section to the fourth section is 75-93 L/min, and the total cooling water amount of the outer arc of the third section to the fourth section is 99-125 L/min; the total cooling water amount of the fifth section to the eighth section specifically comprises: the total cooling water amount of inner arc of the fifth section to the sixth section is 140-189 L/min, the cooling water amount of outer arc of the fifth section to the sixth section is 223-302 L/min, the cooling water amount of inner arc of the seventh section to the eighth section is 97-184 L/min, and the cooling water amount of outer arc of the seventh section to the eighth section is 173-326 L/min. The total cooling water amount of the first section to the fourth section further comprises: the cooling water amount of the upper part of the first section is 246-329 L/min; and Step 4: controlling the cooling water amount of inner arc of the ninth section to the fourteenth section to be 44-64 L/min and outer arc of the ninth section to the fourteenth section not to spray water.

The casting speed of the continuous casting medium-thick slab of peritectic steel is 0.7-0.9 m/min, the specific water amount of the secondary cooling zone is 0.89-0.94 L/Kg, and the water inlet temperature of the cooling water is controlled to be between 30° C. and 40° C.

The present invention based on the study of the heat transfer and solidification numerical simulation and high temperature thermal simulation of the continuous casting slab, the primary cooling water distribution amount of the mould and the secondary cooling water distribution amount of the continuous casting machine are comprehensively optimized to improve the center segregation and surface crack defects of the continuous casting medium-thick slab of peritectic steel at the same time.

The present invention effectively improves the uniformity of the initially solidified shell of the peritectic steel by controlling the cooling water amount of the wide and narrow faces of the copper plate of the mould. According to the technical solution of the present invention, when the cooling water amount of the wide face of the mould is greater than 3600 L/min and the cooling water amount of the narrow face of the mould is greater than 530 L/min, the initially solidified shell at the meniscus will be non-uniform, and the thermal stress on the surface of the continuous casting slab will be increased, so that the occurrence tendency of the surface crack of the continuous casting slab is increased significantly. However, when the cooling water amount of the wide face of the mould is less than 3400 L/min and the cooling water amount of the narrow face of the mould is less than 480 L/min, the bleed-out risk will occur. By controlling the cooling water amount of the wide face of the foot roller to be 239-298 L/min and the cooling water amount of the narrow face of the foot roller to be 61-65 L/min, sufficient strength of the continuous casting slab at the foot roller section can be ensured, the temperature reheating rate of the surface of the continuous casting slab is reduced, and surface crack induced by excessive thermal stress is avoided. By controlling the total cooling water amount of the first section to the fourth section of the segment to be 840-1101 L/min, the cooling intensity at this area can be weakened, the temperature drop rate of the surface of the continuous casting slab can be reduced, and the longitudinal cooling uniformity of the continuous casting slab can be improved. Meanwhile, due to reasonable configuration of the cooling water amount of the mould, the foot roller and the sector segment, the equiaxial crystal ratio of the continuous casting slab can be significantly increased, and the center segregation of the continuous casting slab can be improved.

The total cooling water amount of the fifth section to the eighth section of the sector segment is controlled to be 633-1001 L/min by implementing an intensive cooling strategy at the final stage of solidification of the continuous casting slab. By increasing the temperature drop rate of the surface of the continuous casting slab, the strength of the solidified shell of the continuous casting slab is effectively improved, the bulging amount is reduced, and the center segregation is improved. Meanwhile, compared with the prior art, the present invention has the advantages of reducing the temperature drop rate difference between the surface and the center of the continuous casting slab, increasing the volume shrinkage amount of the solidified shell on the surface of the continuous casting slab, compensating the solidification shrinkage amount of the center of the continuous casting slab and inhibiting the occurrence of a cavity in the center of the continuous casting slab. The cavity will generate negative pressure suction to allow the enriched liquid to enter the center of the slab to lead to center segregation, so intensive cooling at the final stage of solidification of the continuous casting slab is beneficial to improving the center segregation defect of the center of the continuous casting slab.

Based on the above control strategy, the total cooling water amount of the fifth section to the eighth section is specifically controlled as follows: the total cooling water amount of inner arc of the fifth section to the sixth section is 140-189 L/min, the cooling water amount of outer arc of the fifth section to the sixth section is 223-302 L/min, the cooling water amount of inner arc of the seventh section to the eighth section is 97-184 L/min, and the cooling water amount of outer arc of the seventh section to the eighth section is 173-326 L/min, which can ensure that the surface temperature of the continuous casting slab at the end of the seventh section of the sector segment is higher than the upper limit temperature value of a third brittleness area, and the continuous casting slab has high plasticity when being straightened, thus effectively avoiding the obvious increase of the surface crack caused by larger straightening stress at the straightening section (the eighth section of the sector segment).

Compared with the prior art, the technical solution of the present invention has the following beneficial effects:

1) the center segregation proportion of the continuous casting peritectic steel slab obtained on the basis of the technical solution of the present invention is low, and according to the result of experimental detection, the center segregation proportion of the continuous casting slab obtained by the present invention within grade 2.6 reaches more than 82%; and 2) the surface defect rate of the continuous casting peritectic steel slab obtained on the basis of the technical solution of the present invention is low, and according to the experimental detection result, the surface defect rate of the continuous casting slab obtained by the present invention is less than 0.53%.

Embodiment 1

The method provided by the present invention is used for the continuous casting medium-thick slab of peritectic steel of 250 mm*1800 mm, the grade of steel is Q345D, the casting temperature is 1531° C., and the casting speed is 0.70 m/min.

1) the water amount of the mould: the water amount of the wide face is 3500 L/min, and the water amount of the narrow face is 500 L/min; and 2) secondary cooling water amount: the water amount of the wide face of the foot roller is 239 L/min, the water amount of the narrow face of the foot roller is 61 L/min, the water amount of the upper part of the first section of the sector segment is 246 L/min, the water amount of the lower part of the first section of the sector segment is 241 L/min, the water amount of the inner arc of the second section of the sector segment is 84 L/min, the water amount of the outer arc of the second section of the sector segment is 95 L/min, the water amount of inner arc of the third section to the fourth section of the sector segment is 75 L/min, and the water amount of outer arc of the third section to the fourth section of the sector segment is 99 L/min. The water amount of inner arc of the fifth section to the sixth section of the sector segment is 140 L/min, the water amount of outer arc of the fifth section to the sixth section of the sector segment is 223 L/min, the water amount of inner arc of the seventh section to the eighth section of the sector segment is 97 L/min, the water amount of outer arc of the seventh section to the eighth section of the sector segment is 173 L/min, the water amount of inner arc of the ninth section to the fourteenth section of the sector segment is 44 L/min, and outer arc of the ninth section to the fourteenth section of the sector segment do not have water.

The macroscopic examination of center segregation of the continuous casting slab is detected by Mannesmann standard rating, the proportion of the center segregation within grade 2.6 is 82%, and the surface defect ratio of the continuous casting slab is 0.53%.

Embodiment 2

The method provided by the present invention is used for the continuous casting medium-thick slab of peritectic steel of 250 mm*1800 mm, the grade of steel is Q345E, the casting temperature is 1531° C., and the casting speed is 0.80 m/min.

1) the water amount of the mould: the water amount of the wide face is 3500 L/min, and the water amount of the narrow face is 500 L/min; and 2) secondary cooling water amount: the water amount of the wide face of the foot roller is 273 L/min, the water amount of the narrow face of the foot roller is 61 L/min, the water amount of the upper part of the first section of the sector segment is 294 L/min, the water amount of the lower part of the first section of the sector segment is 280 L/min, the water amount of the inner arc of the second section of the sector segment is 96 L/min, the water amount of the outer arc of the second section of the sector segment is 110 L/min, the water amount of inner arc of the third section to the fourth section of the sector segment is 81 L/min, and the water amount of outer arc of the third section to the fourth section of the sector segment is 108 L/min. The water amount of inner arc of the fifth section to the sixth section of the sector segment is 167 L/min, the water amount of outer arc of the fifth section to the sixth section of the sector segment is 270 L/min, the water amount of inner arc of the seventh section to the eighth section of the sector segment is 139 L/min, the water amount of outer arc of the seventh section to the eighth section of the sector segment is 247 L/min, the water amount of inner arc of the ninth section to the fourteenth section of the sector segment is 52 L/min, and outer arc of the ninth section to the fourteenth section of the sector segment do not have water.

The macroscopic examination of center segregation of the continuous casting slab is detected by Mannesmann standard rating, the proportion of the center segregation within grade 2.6 is 85%, and the surface defect ratio of the continuous casting slab is 0.48%.

Embodiment 3

The method provided by the present invention is used for the continuous casting medium-thick slab of peritectic steel of 250 mm*1800 mm, the grade of steel is Q345D, the casting temperature is 1531° C., and the casting speed is 0.90 m/min.

1) the water amount of the mould: the water amount of the wide face is 3500 L/min, and the water amount of the narrow face is 500 L/min; and 2) secondary cooling water amount: the water amount of the wide face of the foot roller is 298 L/min, the water amount of the narrow face of the foot roller is 65 L/min, the water amount of the upper part of the first section of the sector segment is 329 L/min, the water amount of the lower part of the first section of the sector segment is 318 L/min, the water amount of the inner arc of the second section of the sector segment is 110 L/min, the water amount of the outer arc of the second section of the sector segment is 126 L/min, the water amount of inner arc of the third section to the fourth section of the sector segment is 93 L/min, the water amount of outer arc of the third section to the fourth section of the sector segment is 125 L/min, the water amount of inner arc of the fifth section to the sixth section of the sector segment is 189 L/min, the water amount of outer arc of the fifth section to the sixth section of the sector segment is 302 L/min, the water amount of inner arc of the seventh section to the eighth section of the sector segment is 184 L/min, the water amount of outer arc of the seventh section to the eighth section of the sector segment is 326 L/min, the water amount of inner arc of the ninth section to the fourteenth section of the sector segment is 64 L/min, and outer arc of the ninth section to the fourteenth section of the sector segment do not have water.

The macroscopic examination of center segregation of the continuous casting slab is detected by Mannesmann standard rating, the proportion of the center segregation within grade 2.6 is 83%, and the surface defect of the continuous casting slab is 0.46%.

Comparative Example 1

The method provided by the present invention is used for the continuous casting medium-thick slab of peritectic steel of 250 mm*1800 mm, the grade of steel is Q345D, the casting temperature is 1531° C., and the casting speed is 0.70 m/min.

1) the water amount of the mould: the water amount of the wide face is 4100 L/min, and the water amount of the narrow face is 570 L/min; and 2) secondary cooling water amount: the water amount of the wide face of the foot roller is 239 L/min, the water amount of the narrow face of the foot roller is 61 L/min, the water amount of the upper part of the first section of the sector segment is 246 L/min, the water amount of the lower part of the first section of the sector segment is 241 L/min, the water amount of the inner arc of the second section of the sector segment is 84 L/min, the water amount of the outer arc of the second section of the sector segment is 95 L/min, the water amount of inner arc of the third section to the fourth section of the sector segment is 75 L/min, and the water amount of outer arc of the third section to the fourth section of the sector segment is 99 L/min. The water amount of inner arc of the fifth section to the sixth section of the sector segment is 140 L/min, the water amount of outer arc of the fifth section to the sixth section of the sector segment is 223 L/min, the water amount of inner arc of the seventh section to the eighth section of the sector segment is 97 L/min, the water amount of outer arc of the seventh section to the eighth section of the sector segment is 173 L/min, the water amount of inner arc of the ninth section to the fourteenth section of the sector segment is 44 L/min, and outer arc of the ninth section to the fourteenth section of the sector segment do not have water.

The macroscopic examination of center segregation of the continuous casting slab is detected by Mannesmann standard rating, the proportion of the center segregation within grade 2.6 is 70%, and the surface defect ratio of the continuous casting slab is 1.8%.

Comparative Example 2

The method provided by the present invention is used for the continuous casting medium-thick slab of peritectic steel of 250 mm*1800 mm, the grade of steel is Q345D, the casting temperature is 1531° C., and the casting speed is 0.80 m/min.

1) the water amount of the mould: the water amount of the wide face is 3500 L/min, and the water amount of the narrow face is 500 L/min; and 2) secondary cooling water amount: the water amount of the wide face of the foot roller is 261 L/min, the water amount of the narrow face of the foot roller is 51 L/min, the water amount of the upper part of the first section of the sector segment is 294 L/min, the water amount of the lower part of the first section of the sector segment is 312 L/min, the water amount of the inner arc of the second section of the sector segment is 107 L/min, the water amount of the outer arc of the second section of the sector segment is 122 L/min, the water amount of inner arc of the third section to the fourth section of the sector segment is 90 L/min, and the water amount of outer arc of the third section to the fourth section of the sector segment is 120 L/min. The water amount of inner arc of the fifth section to the sixth section of the sector segment is 112 L/min, the water amount of outer arc of the fifth section to the sixth section of the sector segment is 280 L/min, the water amount of inner arc of the seventh section to the eighth section of the sector segment is 92 L/min, the water amount of outer arc of the seventh section to the eighth section of the segment is 164 L/min, the water amount of inner arc of the ninth section to the fourteenth section of the sector segment is 52 L/min, and outer arc of the ninth section to the fourteenth section of the sector segment do not have water.

The macroscopic examination of center segregation of the continuous casting slab is detected by Mannesmann standard rating, the proportion of the center segregation within grade 2.6 is 46.2%, and the surface defect ratio of the continuous casting slab is 2.2%.

Comparative Example 3

The method provided by the present invention is used for the continuous casting medium-thick slab of peritectic steel of 250 mm*1800 mm, the grade of steel is Q345qE, the casting temperature is 1531° C., and the casting speed is 0.90 m/min.

1) the water amount of the mould: the water amount of the wide face is 3500 L/min, and the water amount of the narrow face is 500 L/min; and 2) secondary cooling water amount: the water amount of the wide face of the foot roller is 248 L/min, the water amount of the narrow face of the foot roller is 54 L/min, the water amount of the upper part of the first section of the sector segment is 329 L/min, the water amount of the lower part of the first section of the sector segment is 353 L/min, the water amount of the inner arc of the second section of the sector segment is 122 L/min, the water amount of the outer arc of the second section of the sector segment is 140 L/min, the water amount of inner arc of the third section to the fourth section of the sector segment is 103 L/min, the water amount of outer arc of the third section to the fourth section of the sector segment is 139 L/min, the water amount of inner arc of the fifth section to the sixth section of the sector segment is 126 L/min, the water amount of outer arc of the fifth section to the sixth section of the sector segment is 202 L/min, the water amount of inner arc of the seventh section to the eighth section of the sector segment is 122 L/min, the water amount of outer arc of the seventh section to the eighth section of the sector segment is 217 L/min, the water amount of inner arc of the ninth section to the fourteenth section of the sector segment is 64 L/min, and outer arc of the ninth section to the fourteenth section of the sector segment do not have water.

The macroscopic examination of center segregation of the continuous casting slab is detected by Mannesmann standard rating, the proportion of the center segregation within grade 2.6 is 44.7%, and the surface defect ratio of the continuous casting slab is 1.9%.

TABLE 1

Data table of each sub-section of each sub-segment of secondary cooling zone

| Secondary Cooling Area | Each section of secondary cooling area | Length (m) | Distance away from meniscus (m) |
|---|---|---|---|
| Area 1 | Foot roller | 0.42 | 1.22 |
| Area 2 | Upper part of section 1 | 1.37 | 2.59 |
| Area 3 | Lower part of section 1 | 1.79 | 4.38 |
| Area 4 | Inner arc of section 2<br>Outer arc of section 2 | 2.02 | 6.4 |
| Area 5 | Inner arcs of sections 3-4<br>Outer arcs of sections 3-4 | 4.04 | 10.44 |
| Area 6 | Inner arcs of sections 5-6<br>Outer arcs of sections 5-6 | 4.04 | 14.48 |
| Area 7 | Inner arcs of sections 7-8<br>Outer arcs of section 7-8 | 4.36 | 18.84 |
| Area 8 | Inner arcs of sections 9-11<br>Outer arcs of sections 9-11 | 6.93 | 25.77 |
| Area 9 | Inner arcs of sections 12-14<br>Outer arcs of sections 12-14 | 6.6 | 32.37 |

Table 1 is the data table of each sub-section of each sub-segment of the secondary cooling zone. In the table, the length of each section and the distance away from the meniscus are the commonly used equipment parameters of the secondary cooling area, and the cooling water amount in the embodiments and comparative examples of the present invention is based on the parameters in the table. When the corresponding length and distance change greatly, the cooling water amount of each section in the embodiments and comparative examples of the present invention needs to change correspondingly.

The method for improving the center segregation and surface crack of the continuous casting medium-thick slab of peritectic steel provided by the embodiments of the present invention is described above in detail. The above description of the embodiments is only for helping to understand the method and the core ideal of the present application; meanwhile, for those of ordinary skill in the art, according to the ideal of the present application, there will be some changes in the specific implementation manners and application range. In conclusion, the content of the description should not be construed as a limitation to the present application.

For example, some words are used in the description and the claims to refer specific components. It should be understood by those skilled in the art that hardware manufacturers may use different nouns to refer to the same component. The description and the claims do not use name difference as a way of distinguishing components, but use function difference as a criterion for distinguishing the components. The words "include" or "comprise" as used throughout the description and claims is an open term and should be interpreted as "including/comprising but not limited to". "Approximately" means that within the acceptable error range, and those skilled in the art can solve the technical problem within a certain error range to basically achieve the technical effect. The subsequent description of the description is a preferred embodiment for implementing the present application. However, the description is for describing the general principles of the present application, and is not intended to limit the scope of the present application. The protection scope of the present application should be defined by the appended claims.

It should also be noted that terms "comprising", "including" or any other variations thereof are intended to cover non-exclusive inclusion, so that a commodity or system comprising a series of elements not only comprises those elements, but also comprises other elements that are not explicitly listed, or also comprises elements inherent to the commodity or system. Without more restrictions, an element defined by the phrase "comprising a . . . " does not exclude the presence of another same element in a commodity or system that comprises the element.

It should be understood that the term "and/or" used herein merely describes an association relationship between associated objects, and it indicates three types of relationships. For example, A and/or B can indicate that A exists alone, A and B coexist, or B exists alone. In addition, the character "/" herein generally indicates that the associated objects are in an "or" relationship.

The above description shows several preferred embodiments of the present application, but as described above, it should be understood that the present application is not limited to the form disclosed herein and should not be regarded as an exclusion of other embodiments, but can be applied to various other combinations, modifications and environments and can be modified by the above teaching or technology or knowledge in the related field within the conception scope of the present application described herein. The modifications and changes made by those skilled in the art do not depart from the spirit and scope of the present application and should fall within the protection scope of the appended claims of the present application.

The invention claimed is:

1. A method for improving center segregation and surface crack of a continuously casted medium-thickness peritectic steel slab, comprising:

1) cooling a wide face of a mould with a cooling water at 3400-3600 L/min, and a narrow face of the mould with the cooling water at 480-530 L/min;

2) cooling a wide face of a foot roller section with the cooling water at 239-298 L/min, and a narrow face of the foot roller section with the cooling water at 61-65 L/min; and 3) cooling a sector segment having a first to a fourteenth sections with the cooling water at 1517-2166 L/min, wherein a total cooling water amount used to cool the first section to the fourth section is 840-1101 L/min, and a total cooling water amount used to cool the fifth section to the eighth section is 633-1001 L/min, wherein an amount of the cooling water sprayed to a lower part of the first section is 241-318 L/min, an amount of the cooling water sprayed to an inner arc of the second section is 84-110 L/min, an amount of the cooling water sprayed to an outer arc of the second section is 95-126 L/min, an amount of the cooling water sprayed to an inner arc of the third section to the fourth section is 75-93 L/min, and an amount of the cooling water sprayed to an outer arc of the third section to the fourth section is 99-125 L/min, wherein an amount of the cooling water sprayed to an inner arc of the fifth section to the sixth section is 140-189 L/min, an amount of the cooling water sprayed to an outer arc of the fifth section to the sixth section is 223-302 L/min, an amount of the cooling water sprayed to an inner arc of the seventh section to the eighth section is 97-184 L/min, and an amount of the cooling water sprayed to an outer arc of the seventh section to the eighth section is 173-326 L/min, and wherein an amount of water sprayed to an inner arc of the ninth section to the fourteenth section of the sector segment is 44-64 L/min, and no water is sprayed to an outer arc of the ninth section to the fourteenth section.

2. The method according to claim 1, wherein the cooling water amount of an upper part of the first section is 246-329 L/min.

3. The method according to claim 1, wherein a water inlet temperature of the cooling water is 30-40° C.

4. The method according to claim 1, wherein a casting speed of the continuous casting medium-thick slab of peritectic steel is 0.7-0.9 m/min.

5. The method according to claim 1, wherein the overall specific water amount of the foot roller section and the sector segment is 0.89-0.94 L/Kg.

6. The method according to claim 1, wherein the medium-thickness slab has a cross-section of 250 mm by 1800 mm.

7. The method according to claim 1, wherein the medium-thickness slab of peritectic steel has a proportion of center segregation within grade 2.6 of more than 82%, and a rate of surface defect of less than 0.53%.

* * * * *